United States Patent [19]

Sassmannshausen

[11] Patent Number: 4,570,208

[45] Date of Patent: Feb. 11, 1986

[54] PORTABLE LIGHT, SUCH AS A FLASHLIGHT, SEARCHLIGHT, LANTERN OR THE LIKE AND METHOD OF PRODUCTION THEREOF

[76] Inventor: Knut O. Sassmannshausen, Rothenbach, D-6580 Idar-Oberstein, Fed. Rep. of Germany

[21] Appl. No.: 444,733

[22] Filed: Nov. 26, 1982

[51] Int. Cl.[4] ..... F21L 7/00

[52] U.S. Cl. ..... 362/188; 362/187; 362/202; 362/205; 362/206; 362/277; 362/285; 362/295; 200/60

[58] Field of Search ..... 362/187, 188, 202, 205, 362/206, 277, 285, 295; 200/60

[56] References Cited

U.S. PATENT DOCUMENTS

| | | | |
|---|---|---|---|
| 1,906,268 | 5/1933 | Horowitz | 362/188 |
| 2,176,084 | 10/1939 | Lennan | 362/188 |
| 4,275,435 | 6/1981 | Dorn | 362/376 |
| 4,286,311 | 8/1981 | Maglica | 362/187 |
| 4,398,238 | 8/1983 | Nelson | 362/187 |

*Primary Examiner*—Stephen J. Lechert, Jr.

*Attorney, Agent, or Firm*—Herbert L. Lerner; Laurence A. Greenberg

[57] ABSTRACT

Lamp, including a head, a concave mirror reflector disposed in the head, a battery case, and a carrier for a light source being integral with the battery case forming a one-piece unit, the reflector and the carrier being movable to each other in axial direction, and a method for producing the lamp.

46 Claims, 23 Drawing Figures

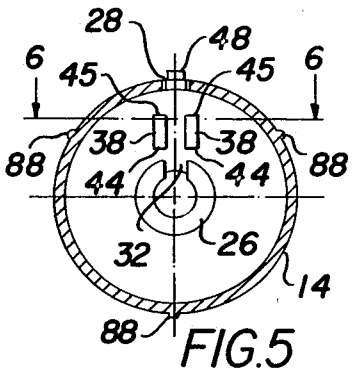
FIG.5
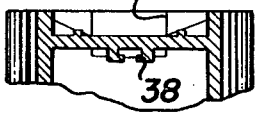
FIG.6
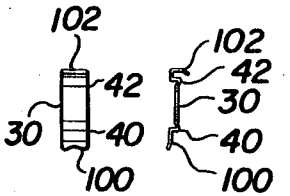
FIG.7a
FIG.7
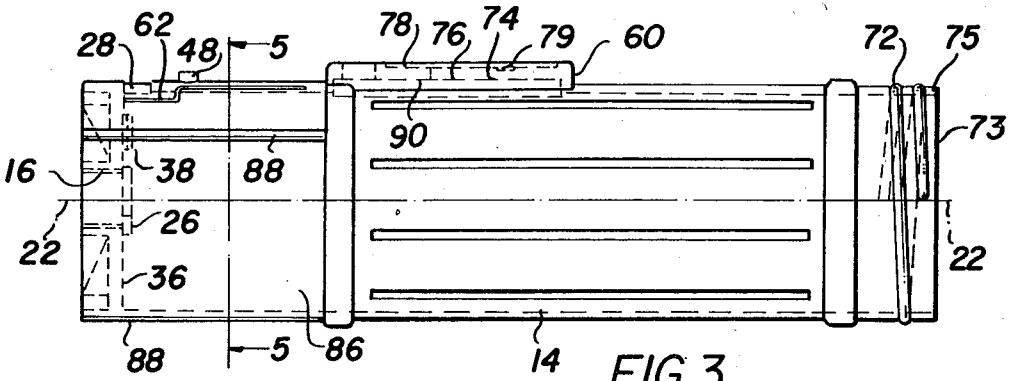
FIG.3
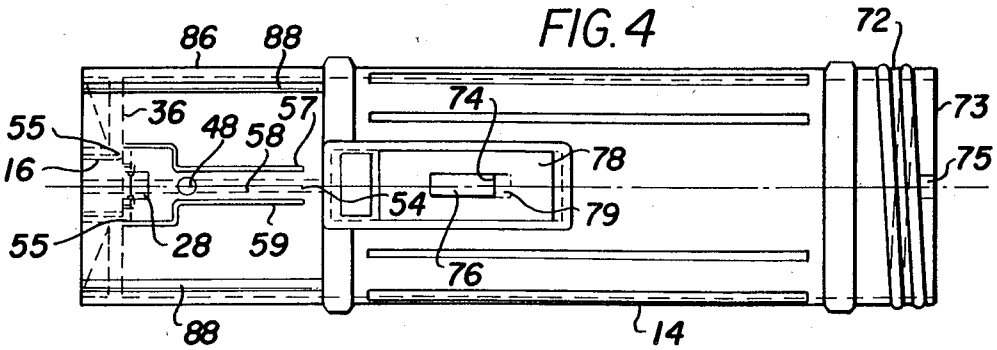
FIG.4

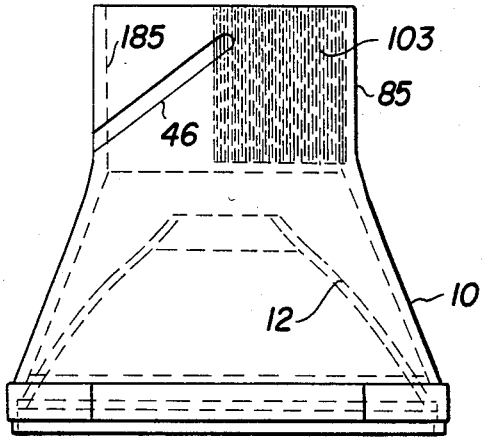
FIG. 13
FIG. 15
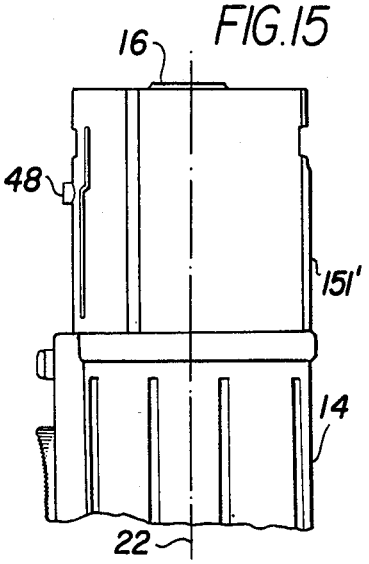
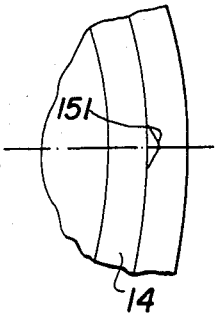
FIG. 16
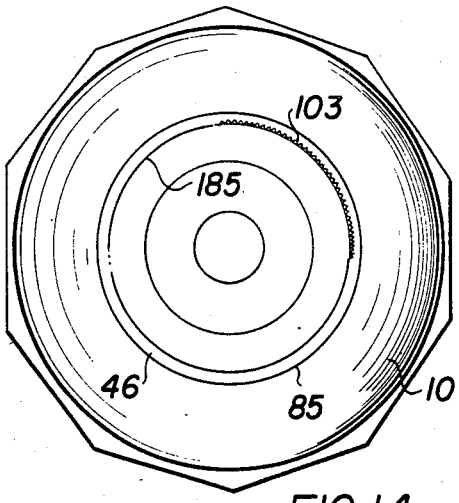
FIG. 14
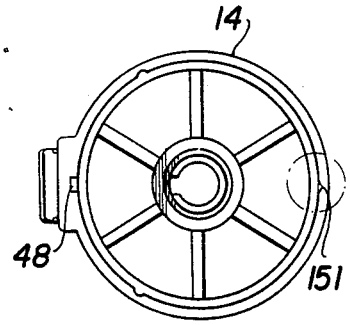
FIG. 17

PORTABLE LIGHT, SUCH AS A FLASHLIGHT, SEARCHLIGHT, LANTERN OR THE LIKE AND METHOD OF PRODUCTION THEREOF

The invention relates to a lamp, especially a rod-shaped lamp or searchlight, or a flashlight, with a lamp head having a concave-mirror reflector and a battery case including a carrier or socket for a light source, especially an incandescent bulb, the concave-mirror reflector and the light source being movable relative to each other in axial direction.

In prior art devices of this type wherein the reflector and light source are movable relative to each other, the carrier or socket for a light source cannot be placed along the axis of the reflector with great accuracy, even when accepting great cost. This is because the normal tolerances occur when fastening the carrier to the battery case.

It is accordingly an object of the invention to provide a lamp, especially a searchlight or flashlight, which overcomes the herein-afore-mentioned disadvantages of the heretofore-known devices and methods of this general type, and to place the carrier or socket of the light source along the axis of the lamp and therefore along the axis of the concave-mirror reflector with such a degree of accuracy that the incandescent bulb along with the light source are therefore also disposed substantially more accurately along the axis of the concave-mirror reflector. This is very important in such hand lamps because even a small deviation of the light source from the axis of the concave-mirror reflector destroys the narrow focusing of a long-distance light beam and the light beam is fanned out instead, which results in a substantial drop in the range of illumination.

It is a further object of the invention to provide a flashlight with an adjustable lamp head which can be manufactured efficiently and thereby cost-effectively. It is an additional object of the invention to disclose a lamp which is reliable in operation and can meet the operational requirements.

With the foregoing and other objects in view there is provided, in accordance with the invention, a lamp in which the carrier or socket of the light source is formed as an integral one-piece unit with the battery case.

In known lamps, especially searchlights or flashlights, the carrier is disposed on a separate part which is pushed into the tubular battery case and is held there by beading-over or rolling-in the wall of the battery case. It has been found in this connection, that if the separate socket part is fastened in the battery case, very large tolerances frequently occur, so that often the axis of the carrier or socket and the axis of the lamp no longer coincide and in particularly flagrant cases, the socket is even shifted out of the center of the lamp axis. As a result, it has been impossible in lamps in which the concave-mirror reflectors and the light source are mutually adjustable in the axial direction, to focus them as exactly as is the case with so-called prefocussed lamps. In such prefocussed lamps, the light source of the incandescent bulb is adjusted so accurately with respect to its flange base, that the incandescent body is placed exactly, within a few hundreths of a millimeter, in the concave-mirror reflector if the bulb is inserted inro such a concave-mirror reflector. The disadvantage of such prefocussed lamps is that the concave-mirror reflector cannot be adjusted axially relative to the light source, so that only narrowly focussed light beams of great range can be obtained with such prefocussed lamps, but not fanned-out light beams for close range. On the other hand, the narrowly focussed light beams of the prefocussed lamps are greatly superior as far as range is concerned, because in lamps or flashlights with adjustable lamp heads which have been used heretofore, the socket for the incandescent bulb cannot be placed accurately enough.

If the socket and the battery case are made of one piece, it is difficult to place the necessary contacts at the socket carrier. According to the invention, this problem is solved by the provision that the battery case has, at the height or level of the end of the carrier located in the direction toward the batteries, a lateral opening through which an elongated contact can be brought into the battery case.

In this manner, the contact which extends from the inner wall of the cylindrical battery case on the end face of the battery case to the base sleeve, need not be brought through the entire length of the battery case from the end thereof which is provided with a screw cap to the end face of the battery case; this contact can rather be fastened quickly and therefore inexpensively at the end face of the battery case through the lateral opening.

To this end, the carrier or socket is advantageously provided in the direction toward the lateral opening of the battery case, with a recess or channel into which an elongated contact extends in order to establish contact with one pole of the light source, i.e., the base sleeve, in this manner.

A further advantageous embodiment of the invention is that guides for an elongated contact are disposed on the inside of the end face of the battery case; these guides are integral with the battery case.

In this manner, an elongated contact can be pushed directly into these guides through the lateral opening, which ensures a reliable and inexpensive contact.

According to the invention, the elongated contact is to have rises and/or depressions which, after the elongated contact is inserted into the guide tracks of the battery case, lock this elongated contact in cooperation with corresponding stop surfaces of the battery case and/or the guide tracks, in such a manner that the elongated contact can slide neither forward nor backward.

During assembly, the elongated contact can therefore be pushed through the lateral opening in the battery case into the guide tracks and pushed forward until a snapping-in click is felt.

In flashlights with adjustable lamp heads, the lamp head has an inclined slot in the part thereof encasing the end of the cylindrical battery case; a guide pin that is resiliently disposed at the battery case engages in the slot. By simple rotation of the lamp head, the guide pin in cooperation with the inclined slot ensures that the lamp head is axially shifted relative to the light source in a known manner. In conventional devices, the guide pin is, as a rule, riveted on a piece of flat spring steel and this piece of flat spring steel is then laboriously riveted by hand to the wall of the battery case, which is very expensive. A substantial cost reduction in the production of such flashlights is achieved, according to the invention, by the feature that the lamp head has an obliquely disposed guide slot formed therein into which a guide pin extends, and that the guide pin is integral with the battery case.

Advantageously, the guide pin is disposed, in accordance with the invention, on a springy part of the battery case and this springy part and the guide pin are integral with the battery case.

It is advantageous if the springy part, according to the invention, is constructed as a tongue, one end of which is integrally connected to the battery case, while on its other end the guide pin is disposed and is integral with the tongue and therefore also with the battery case.

Particularly advantageous is a construction in which, according to the invention, the spring part is constructed as a strip, the beginning and end of which are connected to the battery case, and the guide pin is disposed on this strip and is integral with this strip and therefore with the battery case.

This configuration is particularly advantageous because, due to the connection of the resilient strip at both ends of the battery case, the spring strip and therefore the guide pin as well, exert a substantially stronger spring pressure than is the case with a spring tongue which is connected to the battery case on one side.

A further very advantageous embodiment of such a lamp according to the invention, is the provision that the battery case includes a switch housing or a switch frame, which is likewise integral with the battery case. In this manner, assembly costs can likewise be saved.

A further advantageous embodiment of a lamp according to the invention is that at the edge of the lateral opening, through which an elongated contact can be introduced into the battery case, a bead projecting into the battery case is provided and is likewise integral with the battery case and lifts a switch tongue, when a slide switch is pushed forward. In this way the switch tongue makes contact with the elongated contact. In this manner, the contact can be established reliably when switching-on. In those cases in which the battery case is formed of thermoplastic material, it is advantageous if, in accordance with the invention, a contact, and preferably a contact strip, extends from the interior of the switch housing to an end piece of the battery case which is provided with a thread, and this contact is hung or hooked at the edge of a breakthrough on one hand, and at the end of the end piece of the battery case on the other hand. The contact extends around the edge of the breakthrough in the switch housing and around the end piece of the battery case.

In this manner, this contact strip can be assembled quickly and therefore inexpensively without in any manner interfering with the mechanical processes during switching. In addition, the position thereof in the battery case is accurately fixed in this manner.

To this end, the edge of the breakthrough in the switch frame is deepened from the outside to the inside according to the invention, to such an extent that the contact can extend around the edge, and the contact then rests on the rim while being recessed in such a manner that it does not project into the slide track of the switch.

A further advantageous embodiment of the lamp of the invention is that the contact in vicinity of the interior of the switch frame has detents into which at least one correspondingly shaped bump of the switch tongue snaps and fixes the latter in different switching positions (on,code position,off).

Due to the accurate fixing of the contact by being hooked into the switch frame and around the end piece of the battery case, it is possible to simultaneously use the contact as a detent. By simultaneously using the contact itself as a detent, the contact of the switch tongue can be produced substantially more reliably since oxide layers which might form are immediately eliminated by rubbing during switching.

In cases where this is not possible, the interior of the switch frame has detents which are integral with the battery case and into which at least one correspondingly formed dimple of the switch tongue snaps and fixes the same in its different switch positions.

A further advantageous embodiment of the lamp according to the invention is that the battery case is constructed as a substantially hollow cylinder and that the end piece of the hollow cylinder, in proximity to the carrier, serves as a guide for a cylindrical guide part of the lamp head. The end piece has at least three rises extending parallel to the lamp axis, and advantageously ribs which serve as guides for the lamp head.

This embodiment has the advantage of ensuring accurate guidance parallel to the axis for the lamp head, while simultaneously providing that when the lamp is rotated and is shifted axially in the process, the entire surface of the end piece of the battery case is unscratched. This is particularly important for battery cases which are made of plastic and are subsequently mirror-coated by electroplating or in a high vacuum, for example.

It is especially advantageous if the battery case of a lamp described herein is formed of plastic.

All of the parts of the battery case, i.e., the battery case itself, the carrier or socket, the lateral opening, the guide pin with its resilient support, and the switch housing, as well as the guide tracks for the elongated contact, can be produced in a single operation by injection molding.

Similar advantages are also obtained if, in accordance with the invention, the battery case is made as a metal die casting.

According to the invention, the battery case, the carrier or socket, the guide tracks and the guide pin with its spring part are therefore made in a single injection operation. Another advantageous method is characterized by the feature that the switch housing is also formed-on in the same injection operation. In this case, the switch housing is formed on the inside thereof which is in the battery case, by an internal slide disposed in the inner core of the injection molding die.

Through the use of an internal slide which is disposed in the inner core of the injection mold, the switch housing can therefore be formed beyond the inside diameter of the hollow-cylindrical battery case, and the battery case can nevertheless be removed from the mold because this internal slide is then retracted into the core.

A further advantageous method according to the invention is to fabricate the battery case of plastic and to chrome-plate and/or nickel-plate it subsequently by electroplating.

Another advantageous method is to form the battery case of plastic and to mirror-plate it subsequently with metal vapor in a high vacuum.

Advantageously, the battery case is additionally varnished after the mirror-coating in order to protect this mirror layer.

In accordance with a concomitant feature of the invention, an elevated stop is provided on the head and/or battery case to ensure the maintenance of a desired position or focussing.

Other features which are considered as characteristic for the invention are set forth in the appended claims.

Although the invention is illustrated and described herein as embodied in a lamp, especially a rod-shaped lamp or flashlight, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a side elevational view of the battery case of FIG. 1;

FIG. 4 is a top plan view of the battery case of FIG. 1, as seen in direction of the switch housing;

FIG. 5 is a cross-sectional view taken along the line A–B of FIG. 3, in the direction of the arrows;

FIG. 6 is a fragmentary cross-sectional view taken along the line C–D of FIG. 5, in the direction of the arrows;

Figure 8:
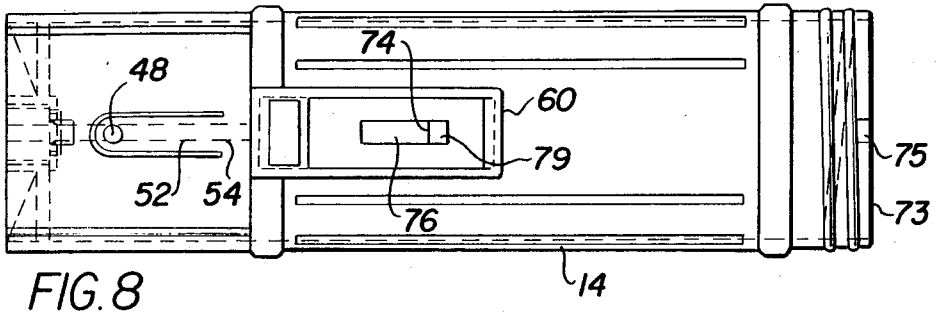
Figure 9:
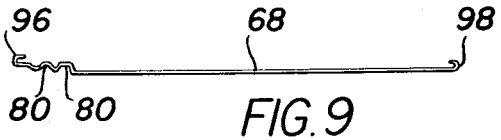
Figure 10:
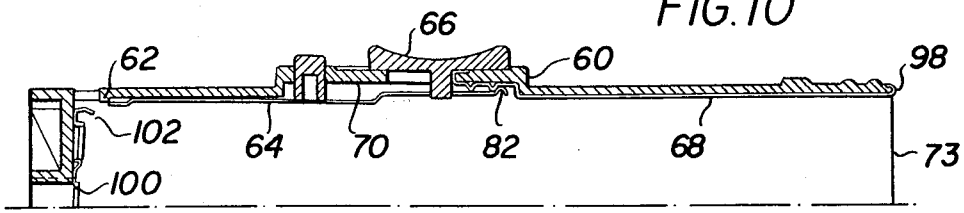
Figure 11:
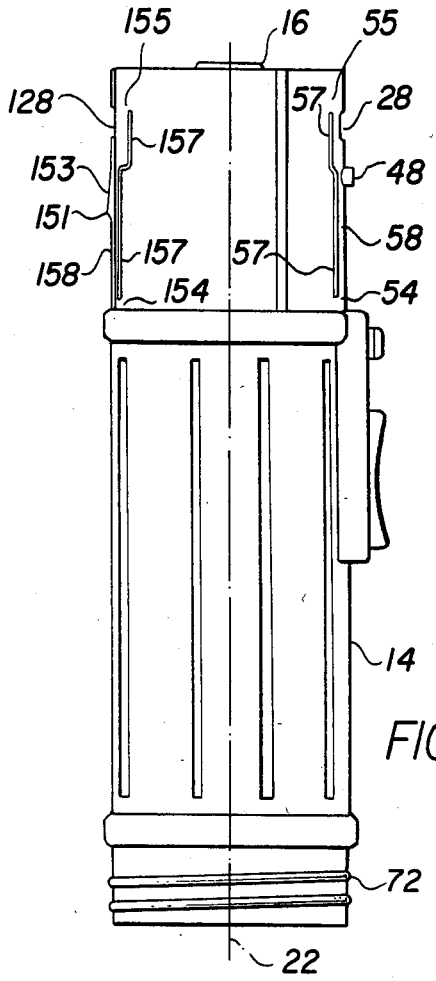
Figure 12:
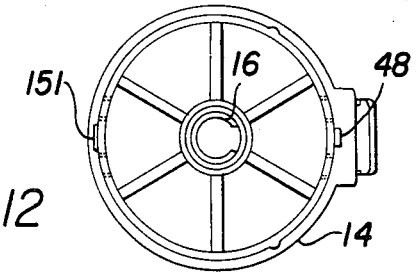
Figure 18:
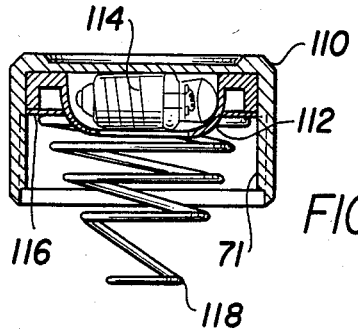
Figure 19:
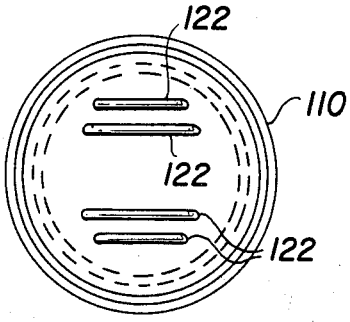
Figure 21:
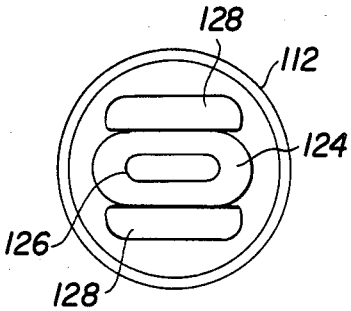
Figure 20:
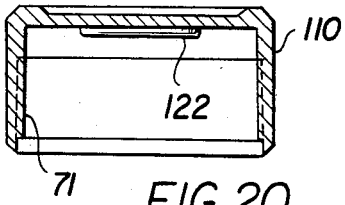
Figure 22:
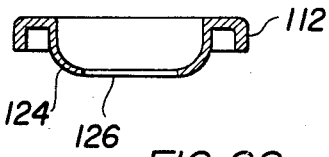
Figure 23:
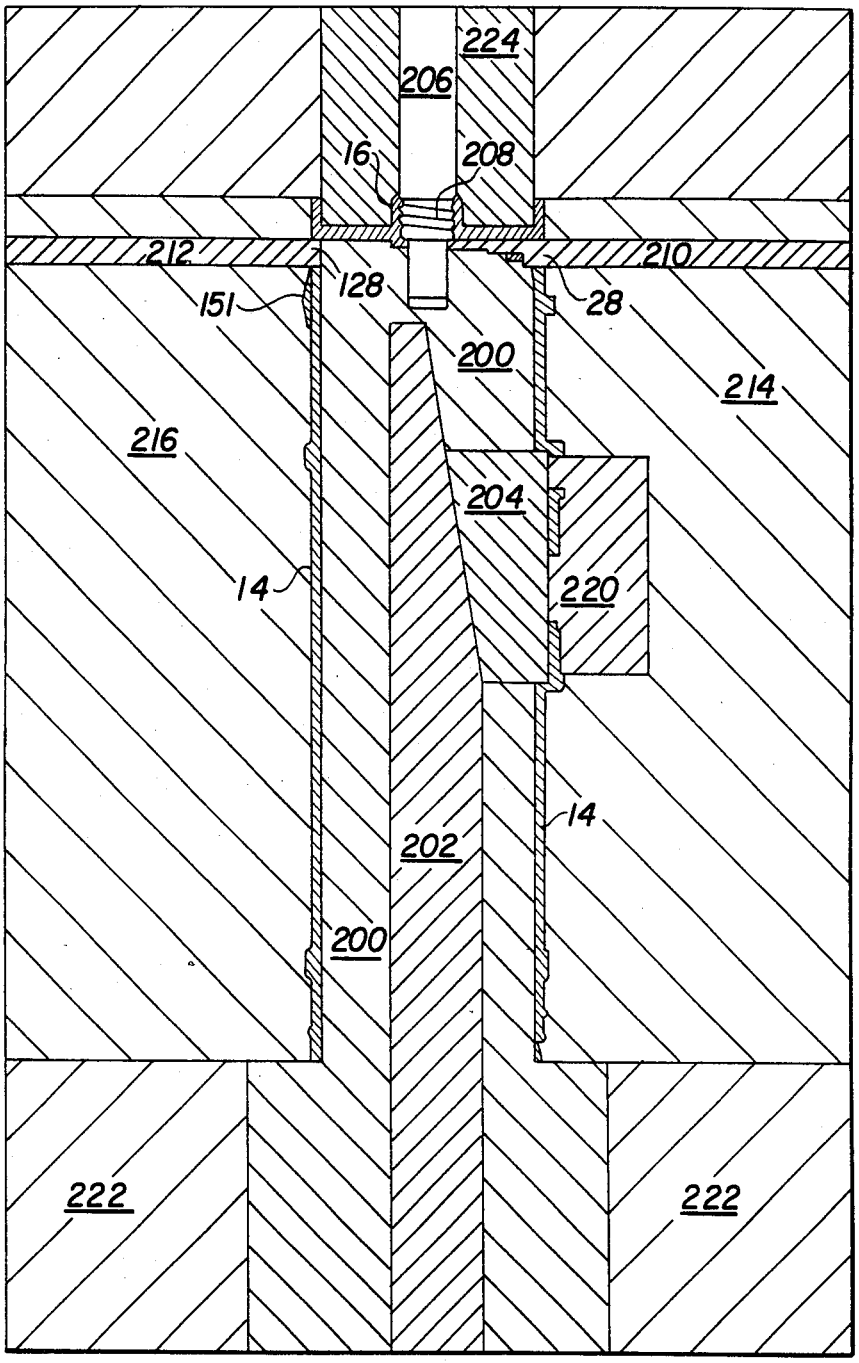

FIGS. 7 and 7*a* are top plan and side elevational views of a contact which is disposed in the guide tracks of the device according to FIGS. 5 and 6;

FIG. 8 is a view similar to FIG. 4 of another embodiment of the battery case, in which the guide pin is disposed on a resilient tongue;

FIG. 9 is an elevational view showing the construction of a contact strip;

FIG. 10 is a cross-sectional view of the disposition of the switch tongue and a further contact strip in the battery case;

FIG. 11 is a side elevetional view of a further embodiment of a flashlight body including a guide pin;

FIG. 12 is an elevational view of the upper end of the flashlight body, as seen from the top of FIG. 11;

FIG. 13 is a side elevational view of a further embodiment of a flashlight head including an area for inhibiting movement of the head;

FIG. 14 is an elevational view of the flashlight head, as seen from the top of FIG. 13;

FIG. 15 is a fragmentary elevational view of the upper part of the flashlight body;

FIG. 16 is a fragmentary view of a part of the flashlight body;

FIG. 17 is an elevational view of the upper end of the flashlight body, as seen from the top of FIG. 15;

FIG. 18 is a cross-sectional view of an assembled end cap;

FIG. 19 is an elevational view of the end cap alone, as seen from the bottom of FIG. 18;

FIG. 20 is a view similar to FIG. 18 of the end cap alone;

FIG. 21 is an elevational view of a spare bulb container alone, as seen from the bottom of FIG. 18;

FIG. 22 is a cross-sectional view of the spare bulb container as seen from the side of FIG. 21; and FIG. 23 is a cross-sectional view of the injection mold for the flashlight body of the invention.

Figure 1:
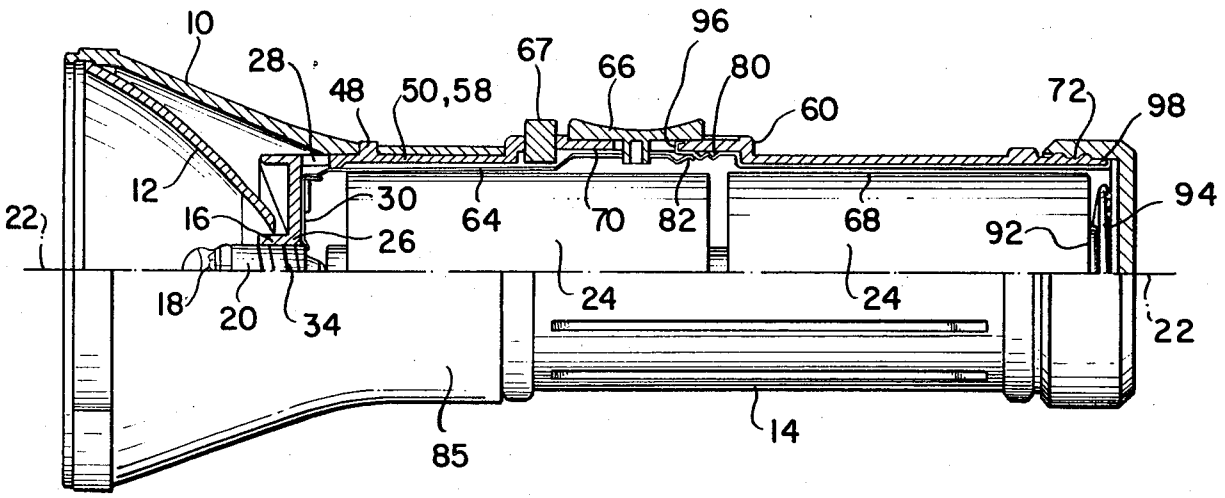
FIG. 1 is a disgrammatic partly cross-sectional view of a rod-shaped lamp of a flashlight.

Referring now to the figures of the drawing and first particularly to FIG. 1 thereof, there is seen a rod-shaped lamp or flashlight according to the invention. Further seen is a battery case 14 which has a carrier or socket 16. A rotatable lamp head 10 is disposed on the end of the case 14. Contrary to conventional flashlights, this socket 16 is constructed, according to the invention, in such a way as to be integral with the battery case 14. This makes it possible to place an incandescent lamp or bulb 20 with its light source 18 exactly on the axis 22 of the flashlight, since the tolerances which always occur if a separate socket is added to a battery case, are eliminated. As a result, a light beam which is particularly narrowly focussed by a concave-mirror reflector 12 and therefore has a particularly long range, is obtained with the flashlight according to the invention. This is accomplished because the ranges of illumination are reduced even if the light source 18 has a tolerance of a few hundreths of a millimeter relative to the axis 22.

In addition, the one-piece construction of the battery case 14 and the socket 16 saves considerable assembly costs.

Batteries 24 are seen in the battery case 14. Furthermore, there is seen a lateral opening 28, through which an elongated contact 30 can be introduced into the battery case to establish contact between a base sleeve 34 and a switch tongue 64, according to the invention.

The method of assembly of the elongated contact 30 which takes place by introduction through the lateral opening 28 according to the invention, is far less laborious than conventional methods, because it can be executed faster than if this contact 30 had to be introduced and assembled from the end 72 of the battery case 14.

In FIG. 1 there is further seen a guide pin 48 which can engage in a guide slot 46 formed in the lamp head 10. By rotating the head 10 or battery compartment 14, the reflector 12 and carrier 16 move axially relative to each other. This guide pin 48 is constructed, according to the invention, along with a springy part 50 of the battery case 14, and is therefore also integral with the battery case 14. Preferably, this spring part 50 is in the form of a resilient strip 58. The one piece construction of the guide pin 48 with the battery case 14 saves considerable assembly costs. In addition, this structure according to the invention, surprisingly is considerably better than that of prior art devices, since a guide pin of this construction is much more able to withstand the lateral stresses which occur when the lamp head 10 is turned. With the assembly according to the invention, it is impossible to unintentionally push the guide pin 48 into the battery case 14 when the lamp head 10 is turned.

It may further be seen in FIG. 1 that the contact between the bottom 92 of the battery 24 and the sleeve 34 of the incandescent lamp 20 is closed by a coil spring 94, a contact strip 68, the switch tongue 64 and the elongated contact 30.

The contact strip 68 and the switch tongue 64 have dimples 80 and 82 disposed in the interior 70 of a switch housing 60 which, according to the invention, is formed in one piece with the battery case 14. This saves considerable costs in assembly. In production, such as in an injection molding process, the interior 70 of the switch housing 60 is formed by a movable inner slide which is disposed in the core that forms the battery compartment of the battery case 14.

FIG. 1 also illustrates a slide switch 66 to which the switch tongue 64 is fastened, and additionally there is further seen a code switch 67.

Figure 2:
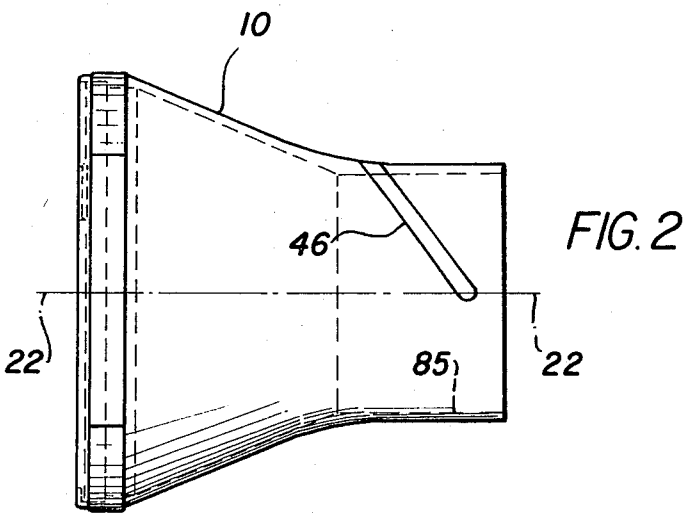
FIG. 2 is a side elevational view of the lamp head of FIG. 1.

FIG. 2 shows the lamp head 10 of the flashlight of FIG. 1. This lamp head 10 has an inclined guide slot 46 in which the guide pin 48 of the battery case 14 can engage. The lamp head 10 has a cylindrical guiding part 85 on the inside thereof. This guiding part 85 together with guide ribs 88 shown in FIGS. 3, 4 and 5, causes the lamp head 10, and therefore also the concave-mirror reflector 12, to be held exactly on the axis of the flashlight if the lamp head is axially shifted relative to the light source 18 through rotation.

FIG. 3 shows the battery case 14 in a side view. In detail, in FIG. 3 there is seen the carrier or the socket 16 with an end 26 thereof facing the batteries. Further seen are guide tracks 38 which are integrally formed on the inside end face 36 of the battery case 14. The elongated contact 30 can be inserted into the guide tracks 38 through the opening 28 according to the invention. On the inside of the battery case 14, shortly ahead of the opening 28, a bead 62 is integrally formed with the battery case, according to the invention. This bead 62 pushes the switch tongue 64 inward against the elongated contact 30 if the lamp is switched on by pushing the switch 66 forward. FIG. 3 also illustrates the guide pin 48 and the guide ribs 88 guiding the lamp head 10.

The switch housing 60 has a breakthrough 76, through which the connection between the slide switch 66 and the switch tongue 64 is established. At the edge of this breakthrough 76, a depression 79 in a sliding track 78 of the slide switch 66 is formed, according to the invention. According to the invention, as seen in FIGS. 1, 9 and 10, the contact strip 68 can be hung in the depression 79 with a first bent-over end 96 thereof. A second bent-over end 98 of the contact strip 68 is hung at the end 73 of the battery case 14 in a depression 75 which is formed at the end 73, according to the invention.

FIG. 4 shows a top plan view of FIG. 3 onto the switch housing. In FIG. 4, the guide pin 48 is seen very clearly to be disposed, according to the invention, on a resilient strip 58 of the battery case 14 and, further according to the invention, the pin 48 and strip 58 are seen to be formed in one piece. This resilient strip 58 is produced by breaking through the battery case laterally to the strip 58, along lines 57 and 59.

According to the invention, the resilient strip 58 is thus connected at both end regions 54 and 55 thereof to the battery case 14, where according to the invention, the end region 55 of the resilient strip 58 was advantageously brought around the opening 28.

If the battery case is made of plastic or as a metal casing, it is very simple to make the resilient strip 58 with its guide strip 48, according to the invention, and production can be effected, according to the invention, by an injection molding (or die-casting) process together with the production of the battery case 14.

However, even in the case of battery cases which are made of sheet metal and which are deep-drawn or extruded, the construction according to the invention in which the guide pin is in one piece with the resilient part and the battery case is very advantageous. According to the invention, the separation lines 57 and 59 of a resilient strip 58 or a resilient tongue 52 shown in FIG. 8 can be punched out in such a construction of the battery case and, according to the invention, the guide pin 48 can be drawn from the material of the resilient strip 58 or the resilient tongue 52. Another advantage of such a construction of the battery case is that an expensive assembly of a separate spring arm with a guide pin is no longer necessary. In FIG. 4 there can further be seen the depression 79 in the slide track 78 of the slide switch 66 according to the invention, into which the first bend-over end 96 of the contact strip 68 is to be hung, while the other end 98 of the contact strip 68 is hung into the depression 75, according to the invention, which is formed at the end 73 of the battery case 14.

FIG. 5 shows a cross-sectional view taken along the line A–B in FIG. 3, in the direction toward the end face 36 of the battery case 14. FIG. 5 shows the battery case 14, on which, according to the invention, at least 3 guide ribs 88 are disposed integrally with the battery case 14. The end 26 of the socket 16, which has a channel or cutout 32 formed therein according to the invention, is further seen to be disposed in the direction toward the opening 28.

Through this opening 28, the elongated contact 30 shown in FIG. 7 can be introduced and pushed into the guide tracks 38, where one end 100 of the contact 30 extends into the cutout 32 in order to establish contact with the base sleeve 34 of the incandescent lamp 20. The contact 30, according to the invention, has a rise 40 which must be pushed by force through the guide track 38 and then serves as a stop against end surfaces 44 of the guide tracks 38 in order to reliably prevent the contact 30 from sliding back. A further rise 42, which advantageously is made somewhat heavier, strikes other end faces 45 of the guide tracks 38, so that the contact strip 30 does not extend too far into the socket 16, since otherwise the base insulator of the incandescent lamp would lift the contact off the base sleeve and the lamp could not burn.

FIG. 6 shows a cross-sectional view taken along the line C–D in FIG. 5. It can be better seen in FIG. 6 how the guide tracks 38 are constructed. According to the invention, the opening 28 and the guide tracks 38 as well as the bead 62 and the cutout 32 in the socket 16 are all aligned in one direction, so that they can be removed from the die, according to the invention, with only one plug which, in the injection process, extends from the outside into the inner core of the battery case 14.

FIGS. 7 and 7*a* show the elongated contact 30 with the end 100, the first rise 40 and the second rise 42 in a top plan view and a side view, respectively.

FIG. 8 shows a second embodiment of the battery case 14 according to the invention, in which the guide pin 48 is disposed on a resilient tongue 52 which is integrally formed with the battery case 14 only at a location 54.

FIG. 9 shows the contact strip 68 which is to extend from the switch housing 60 to the end 73 of the battery case 14. To this end, the contact strip 68 has, according to the invention, the first bend-over end 96 which extends through the breakthrough 76 of the switch housing 60 and is placed around an edge 74 of the breakthrough 76 and comes to lie with its end in the depression 79. Meanwhile, the second end 98 of the contact strip 68 is likewise bent over, according to the invention, the end of the contact strip 68 lying in the depression 75 of the battery case 14. In FIG. 9 it is further seen that the contact strip 68 has the detents or dimples 80.

FIG. 10 shows, in an assembled view, how the contact strips 68 and 30 as well as the switch tongue 64 are disposed, in the battery case 14.

If the switch tongue 64 is pushed forward with the aid of the slide switch 66, it is pushed inward by the bead 62 against a bent-over end 102 of the contact 30. The switch tongue 64 has at least one dimple 82 which, according to the invention, fits corresponding detents 80 of the contact strip 68 and thus locks the switch in different switching positions.

Instead of the contact strip 68, the interior 70 of the switch housing 60 could also have corresponding detents; but it was seen to be more advantageous according to the invention, to form them on the contact strip 68, since in this manner, contact during the different switching positions (on-code-off) is substantially more reliable.

FIG. 11 shows a third embodiment of a battery container or flashlight body 14 with a guide pin 48, which should extend into an inclined slot formed in the flashlight head. The guide pin 48 is formed as a one-piece unit with the guide pin holder strip 58 and the battery container or flashlight body 14. The ends of the guide pin holder strip 58 meet the battery container at locations 55 and 54 forming a one-piece integral unit with the battery container 14. In order to provide a spring effect for the guide pin holder strip 58, it is partly separated from the battery container 14 by the slot-shaped separations 57 and 59 (the separation 59 is not shown in FIG. 11). Preferably, on the opposite side of the guide pin holder strip 58, another holder strip 158 is disposed, which also has a spring effect because it is only connected at locations 154 and 155 at the ends thereof with the battery container 14, while the sides of the holder strip 158 are separated from the battery container 14 by means of separating slots 157 and 159 (slot 159 not being shown). On the holder strip 158, there is a radial extension 151 which is preferably combined with a ramp-shaped part 153 of the second holder strip 158. The spring mounted extension 151 presses against the inner surface 185 of the cylindrical guide part 85 of the focussing flashlight head 10 of FIGS. 1, 2, 13 and 14 in order to firmly hold the head 10 in a desired position after having focussed the head 10. This is an embodiment of the invention to keep the head firmly in a focussed or desired position. Referring to the invention, the head is not permitted to accidentally leave a focussed or desired position because of a shock or the like, but is firmly kept in position by the pressure of the extension 151, until the user of the flashlight desires to move the head 10 of the flashlight into another position by twisting the head with his hands. In this way, an unwanted accidental loss of the focussed position of the head 10 is prevented by the invention. Therefore, the portable light (flashlight, searchlight, lantern etc.) of the invention combines the features of a prefocussed flashlight and a focussing flashlight into one new flashlight. Instead of having one stop means 151, two or more can also be provided without departing from the spirit of the invention.

In FIG. 11, the opening 28 in the battery container or flashlight body is seen. Through the opening 28, the contact strip between the lamp base and the metal strip of the switch, can be inserted, in accordance with another object of the invention. As will be discussed later on with reference to FIG. 23; it is further a purpose of the opening 28 to allow support to be inserted through the opening 28 to contact the inner die of the battery container during injection molding.

Directly opposite the opening 28 is another opening 128 through which the inner die of the battery container is supported from the other side during injection molding of the battery container 14.

FIG. 12 shows a view onto the top of FIG. 11. It shows the guide pin 48 and the radial extension 151 (which stops the movement of the head in a desired position).

FIG. 13 shows the head 10 of a flashlight, with the concave reflector 12. As mentioned above, the head 10 has a cylindrical guide part 85, the inner surface of which is shown at reference numeral 185. Opposite the inclined slot 46 there is seen an area 103. Within the area 103, the inner surface 185 of the head 10 is provided with a great number of small grooves or flutes into which the radial extension 151 will protrude in order to stop the movement of the head in a desired position. The area 103 is thus provided with means for enlarging the friction between the inner surface 185 of the head 10 and the extension 151 of the battery container 14. Preferably, the distance between each groove or flute is smaller than 0.5 mm or 0.02 inches in order to arrive at an exact focus position. If the spring power of the extension 151 is strong enough, the invention will also work with a smooth inner surface 185.

FIG. 14 shows the head 10 towards the small end thereof. The cylindrical guide part 85 and its inner surface 185 can be seen, along with the inclined guide slot 46 and, on the opposite side, the area 103 with the grooves or flutes. Instead of grooves or flutes, other means of providing more friction can be used, without departing from the spirit of the invention.

The stop means provided by the extension 151 could also be provided on the head 10 instead of being provided on the battery container 14, without departing from the spirit of the invention.

FIGS. 15, 16 and 17 show stopping means 151' which are firm and which do not have an extra spring effect. A small but sufficient spring effect is provided by the material of the battery container 14, such as plastic.

It is a further object of the invention to provide a spare bulb in the endcap of a flashlight, which is protected from shock and mechanical damage by a spare bulb container.

FIG. 18 shows an endcap 110 into which a spare bulb container 112 is inserted. The spare bulb container 112 holds and protects a spare bulb 114. On the spare bulb container 112, there is a metal ring 116, which holds a spiral wire spring 118. The metal ring 116 provides safe contact with the contact strip 98 shown in FIG. 10. Furthermore, the metal ring 116 holds the spiral wire spring 118 in a central position by means of small clamps stamped out of the metal ring 116. Because of the clamps, the spiral wire spring 118 is centralized and is prevented from scratching the threaded end 72 of the battery container 14. The endcap 110 has an inner thread 71 which corresponds with the thread 72 of the battery container.

FIG. 19 shows a view into the endcap 110. At the bottom of the endcap 110 small ribs 122 are provided. These ribs 122 are also shown in FIG. 20. The small ribs prevent the spare bulb container 112 from rotating in the endcap 110, when the endcap 110 is screwed to the battery container 14.

FIGS. 21 and 22 show the spare bulb container 112 with a protective hood 124, which has a small opening 126 that permits the user to see whether a spare bulb 114 is loaded in the spare bulb container 112. Two longitudinal openings 128 are shown into which the ribs 122 of the endcap 110 extend in order to prevent the spare bulb container 112 from rotating axially when screwing the endcap 110 to the battery container 14.

FIG. 23 shows a diagrammatic, cross-sectional representation of the injection mold for the production of the battery container or flashlight body 14 of the invention.

The injection mold is shown in a closed position with a battery container or flashlight body 14 just ready to be injection molded.

Jaw dies 214, 216 and an inner die 200, which forms the open space for the batteries, are seen in the drawing. According to the invention, the inner die 200 has a moving element 202 inside the inner die 200. The moving element 200 moves another moving element 204, which shapes an extra space for the elements of the switch. The extra space extends beyond the inner diameter of the battery container in order to provide extra room for the elements of the switch.

According to the invention, the movement of moving element 204 (which moves inside the inner die 200) can be performed by moving the moving element in axial direction with respect to the axis of the battery container or, without departing from the spirit of the invention, a cam could be provided for the moving element 202 as well, and the movement of the moving element 204 could be performed by rotating the element 202 with respect to the inner die 200. According to the invention another die 206, which contacts the inner die 200 directly or indirectly during injection of the plastic materials, is provided. It is advantageous for the die 206 to extend into the die 200 in order to support die 200 during injection of the plastic materials. According to the invention, the die 206 is provided with a thread 208 for the lamp holder 16. According to the invention, the die 206 will be retracted after injection molding by rotating the die 206 with respect to the battery container 14. After the thread 208 of the die 206 has left the lamp holder 16, the die 206 will be completely withdrawn from the battery container 14.

According to the invention, two supporting element dies 210 and 212 (of jaw dies 214 and 216 of the mold) support the inner die 200 during injection molding. The die 210 forms guide means for the contact element 30 between the lamp holder 16 and other contact elements of the switch. The dies 210 and 212 can be firmly connected with the jaw dies 214 and 216 or can even be a one piece unit with the jaw dies.

In a preferred embodiment of the invention, the die 210 is movable in radial direction with respect to jaw die 214.

The guide pin 48 is shown as well as the stopping means 151. Inside the jaw die 214 there is an additional die 220, which forms the cavities of the switch. The die 220 can also be formed as a one piece unit with the jaw die 214.

According to the invention, the movements of the injection molds are as follows:

A carrier 222 of the inner die 200 moves towards the die 206 until it arrives in injection position. The jaw dies 214 and 216 are now closing. The dies 206 and 202 are moved toward the die 200 in order to reach injection ppsition. If separately moved, the die 210 moves toward the axis of the battery container 14.

The die 202 lifts the inner moving element 204. Subsequently, the mold is ready for injection of the plastic material. After injection the mold opens as follows:

The die 202 moves in order to let the die 204 move back toward the axis 22 of the battery container 14. Next, the die 200 is retracted, while the jaw dies 214 and 216 are still closed. Before doing so, the die 210 will be preferably removed in order to protect the die 200. Die 206 will rotate in order to form the thread of the lamp holder 16. After the movement, the dies 206 and 224 are retracted.

Finally, the jaw dies 214 and 216 are opened in order to expel the battery container 14.

It is, of course, only possible to show a few preferred embodiments of the invention in the drawings; a multiplicity of further embodiments is possible without deviating from the idea of the invention.

I claim:

1. Lamp, comprising a head, a concave mirror reflector disposed in said head, a battery case, and a carrier for a light source being integral with said battery case forming a one-piece unit, said reflector and said carrier being movable relative to each other in axial direction.

2. Lamp, comprising a head, a concave mirror reflector disposed in said head, a battery case, a carrier for a light source being integral with said battery case forming a one-piece unit, said reflector and said carrier being movable relative to each other in axial direction, said carrier having an end adjacent said battery case, and said battery case having an opening formed therein adjacent said end of said carrier, and an elongated contact being insertable through said opening into said battery case.

3. In a lamp having a battery case, a carrier for a light source having an end thereof being disposed on the battery case, and a contact, the improvement comprising the battery case having an opening formed therein adjacent the end of the carrier for insertion of the contact.

4. Lamp, according to claim 2, wherein said battery case has a channel formed therein in alignment with said opening for receiving said elongated contact for establishing contact with a pole of the light source.

5. Lamp according to claim 2, wherein said battery case has an end adjacent said end of said carrier and an inner surface of said end of said battery case, and including guides for said elongated contact being integral with said inner end surface of said battery case.

6. Lamp according to claim 4, wherein said battery case has an end adjacent said end of said carrier and an inner surface of said end of said battery case, an including guides for said elongated contact being integral with said inner end surface of said battery case.

7. Lamp according to claim 6, wherein said opening, guide tracks and channel are in alignment from the periphery of said battery case to the axis thereof.

8. Lamp according to claim 5, wherein said elongated contact has non-planar regions formed therein for locking said elongated contact in place and for preventing sliding after said elongated contact is inserted into said guide tracks.

9. Lamp according to claim 5, wherein said elongated contact has rises formed thereon for locking said elongated contact against corresponding surfaces of said guide tracks and for preventing sliding after said elongated contact is inserted into said guide tracks.

10. Lamp according to claim 1, wherein said head has an inclined guide slot formed therein, and said battery case has a guide pin being integral therewith forming a one-piece unit, said guide pin being insertable in said guide slot.

11. In a lamp, having a battery case and a head, the improvement comprising a guide pin being integral with said battery case forming a one-piece unit and said head having an inclined guide slot formed therein for receiving said guide pin.

12. Lamp according to claim 10, including a resilient part of said battery case on which said guide pin is disposed, said guide pin and resilient part being a one-piece integral unit with said battery case.

13. Lamp according to claim 12, wherein said resilient part is in the form of a tongue having an end being integral with said battery case and another free end, said guide pin being disposed on and integral with said free end of said tongue.

14. Lamp according to claim 12, wherein said resilient part is in the form of a strip having two ends being integral with said battery case, said guide pin being disposed on and integral with said strip.

15. Lamp according to claim 14, wherein said opening for insertion of said elongated contact is formed in said strip.

16. Lamp according to claim 15, wherein one of said ends of said strip at least partially encloses said opening.

17. Lamp according to claim 1, including a switch housing being integral with said battery case, forming a one-piece unit, said battery case having an increased interior space and diameter in vicinity of said switch housing.

18. In a lamp having a battery case, the improvement comprising a switch housing being integral with said battery case forming a one-piece unit, said battery case having an increased interior space and diameter in vicinity of said switch housing.

19. Lamp according to claim 2, including a bead being disposed in and integral with said battery case at an edge of said opening forming a one-piece unit with said battery case, a switch disposed on said battery case, and a switch tongue being disposed in said battery case at least from said switch to said bead, said switch tongue being lifted by said bead upon actuation of said switch for making contact with said elongated contact.

20. Lamp according to claim 17, wheein said switch housing has a breakthrough formed therein with a rim and said battery case has a threaded end piece with an edge at an opposite end of said battery case from said carrier, and including a contact being disposed in said battery case and having regions being hooked on said rim of said breakthrough into said switch housing and being hooked around said edge of said end piece.

21. Lamp according to claim 20, including a switch being slidable in a slide track in said switch housing, said rim of said breakthrough in said switch housing having a depression formed therein from the outside of said switch body, said region of said contact hooked on said rim being partly disposed in said depression and out of said slide track.

22. Lamp according to claim 20, including a switch tongue being disposed in said battery case at least from said switch to the vicinity of said elongated contact, said switch tongue having at least one bump formed thereon in vicinity of the interior of said switch housing, and said contact having detents formed therein for receiving said bump of said swtich tongue and for snapping and fixing said switch tongue in different switching positions.

23. Lamp according to claim 21, including a switch tongue being disposed in said battery case at least from said switch to the vicinity of said elongated contact, said switch tongue having at least one bump formed thereon in vicinity of the interior of said switch housing, and said contact having detents formed therein for receiving said bump of said switch tongue and for snapping and fixing said switch tongue in different switching positions.

24. Lamp according to claim 20, including a switch tongue being disposed in said battery case at least from said switch to the vicinity of said elongated contact, said switch tongue having at least one bump formed thereon in vicinity of the interior of said switch housing, and said switch housing having detents formed therein being integral with said battery case forming a one-piece unit for receiving said bump and for snapping and fixing said switch tongue in different switching positions.

25. Lamp according to claim 21, including a switch tongue being disposed in said battery case at least from said switch to the vicinity of said elongated contact, said switch tongue having at least one bump formed thereon in vicinity of the interior of said switch housing, and said switch housing having detents formed therein being integral with said battery case forming a one-piece unit for receiving said bump and for snapping and fixing said switch tongue in different switching positions.

26. Lamp according to claim 1, wherein said head has a cylindrical guide part, and said battery case is in the form of a substantially hollow cylinder having an end piece in vicinity of said carrier for guiding said cylindrical guide part, and including at least three protrusions disposed on said end piece in axial direction for guiding said head.

27. Lamp according to claim 1, wherein said battery case is formed of plastic.

28. Lamp according to claim 1, wherein said battery case is formed of a metal casting.

29. Lamp according to claim 1, wherein said head has a guiding part having an inner surface, said battery case has a substantially cylindrical guiding region in vicinity of said carrier, and said guiding region has an elevated stop region pressing against said inner surface of said guiding part of said head, for positioning said head in a desired position.

30. In a lamp, having a battery case, a carrier for a light source being disposed on said battery case, and a head, the improvement comprising a guiding part of the head having an inner surface, a substantially cylindrical guiding region of said battery case disposed in vicinity of said carrier, and an elevated stop region being disposed on said guiding region and pressing against said inner surface of said guiding part of said head, for positioning said head in a desired position.

31. Lamp according to claim 29, wherein said elevated stop region is integral with said battery case forming a one-piece unit.

32. Lamp according to claim 31, including a resilient tongue being integral with said battery case forming a one-piece unit, said elevated stop region being integral with said resilient tongue.

33. Lamp according to claim 32, wherein said resilient tongue has two ends being connected to said battery case.

34. Lamp according to claim 29, wherein said elevated stop region has a slightly inclined region rising from said battery case, to facilitate sliding said head onto said battery case.

35. Lamp according to claim 29, wherein said inner surface of said guiding part of said head is roughened to facilitate stopping said head in a desired position.

36. Lamp according to claim 1, wherein said battery case has a substantially cylindrical guiding region, said head has a cylindrical guiding part having an inner surface, and said inner surface of said guiding part has an elevated stop device formed thereon passing against said guiding region for holding said head in a desired position.

37. In a lamp having a battery case and a head, the improvement comprising a substantially cylindrical guiding region formed on the battery case, a cylindrical guiding part with an inner surface being formed on the head, and an elevated stop device being formed on said inner surface of said guiding part and pressing against said guiding region for holding the head in a desired position.

38. Lamp according to claim 36, wherein said elevated stop device is integral with said head forming a one-piece unit.

39. Lamp according to claim 38, including a resilient tongue being integral with said head forming a one-piece unit, said elevated stop device being integral with said tongue.

40. Lamp according to claim 39, wherein said resilient tongue has two ends being connected to said head.

41. Lamp according to claim 36, wherein said elevated stop device has a slightly inclined region rising from said head, to facilitate sliding of said head onto said battery case.

42. Lamp according to claim 36, wherein said guiding region of said battery case has a roughened surface cooperating with said guiding part of said head, to facilitate stopping said head in a desired position.

43. Lamp according to claim 29, including at least one additional elevated stop region disposed on said battery case.

44. Lamp according to claim 36, including at least one additional elevated stop device disposed on said head.

45. Lamp according to claim 1, including means for holding said head in a desired position relative to said battery case.

46. Lamp, comprising a head, a concave mirror reflector disposed in said head, a battery case, a carrier for a light source being disposed on said battery case, said reflector and said carrier being movable relative to each other in axial direction, and means for holding said head in a desired position relative to said battery case.

* * * * *